United States Patent [19]

Shea, Jr. et al.

[11] Patent Number: 5,026,581

[45] Date of Patent: Jun. 25, 1991

[54] INVISIBLE MULLION ASSEMBLY

[76] Inventors: John R. Shea, Jr., 6404 Murray Hill Rd., Baltimore, Md. 21212; A. Risher Hall, 702 Willow Valley Lakes Dr., Willow Street, Pa. 17584

[21] Appl. No.: 389,236

[22] Filed: Aug. 3, 1989

[51] Int. Cl.[5] ..... E04C 2/54; E06B 3/24

[52] U.S. Cl. ..... 428/34; 428/58; 52/398; 52/403; 52/777; 52/788; 52/790

[58] Field of Search ..... 428/34, 38, 58; 52/171, 52/172, 288–290, 398, 403, 777, 821; 196/107, 109

[56] References Cited

U.S. PATENT DOCUMENTS

| | | | |
|---|---|---|---|
| 4,464,874 | 8/1984 | Shea | 52/398 |
| 4,500,572 | 2/1985 | Francis | 438/34 |
| 4,552,790 | 11/1985 | Francis | 428/34 |
| 4,604,484 | 8/1986 | Mondon | 52/172 |
| 4,650,702 | 3/1987 | Whitmyer | 428/31 |
| 4,680,206 | 7/1987 | Yoxon | 428/34 |
| 4,691,489 | 9/1987 | Shea | 52/235 |
| 4,766,709 | 8/1988 | Galbraith | 52/235 |

*Primary Examiner*—Ellis P. Robinson
*Assistant Examiner*—Donald J. Loney
*Attorney, Agent, or Firm*—David H. Semmes

[57] ABSTRACT

Multiple pane window glass units of the type having abutting pairs of panes fitted between a head and sill. Particularly an "invisible" mullion assembly comprises of a pair of H-shaped vertical channels extending vertically between head and sill and interposed between the vertical edges of each abutting pair of panes so as to stabilize and support the panes of each pair, together with a T-shaped mullion, having an elongate shank with an outer tip vertically extending between abutting pairs of glass pane edges and a flat inner base extending vertically over abutting inner glass pane edges. An outer gasket is fitted over the end of the T-shaped mullion so as to be compressed between the abutting pairs of outer glass pane edges, while engaging said H-shaped channels. A centering guide positions the Y-shaped mullion at the abutting pairs of inner glass pane edges. Structural silicone caulking is applied in the space between glass and flat inner base of the mullion vertically on both sides and laterally across the joints at the top and bottom. This holds the mullion assembly together forming a box beam and also sealing against air and water leakage past the joint.

11 Claims, 9 Drawing Sheets

INVISIBLE MULLION ASSEMBLY

BACKGROUND OF THE INVENTION (1) Field of the Invention

Multiple pane glass window units, particularly, an invisible mullion for sealing and supporting pairs of glass pane ends in abutting relationship.

(2) The Prior Art

SHEA, JR., et al.: 4,464,874
FRANCIS 4,500,572
MONDON 4,604,840
WHITMYER 4,650,702
SHEA, JR., et al. 4,691,489
GALBRAITH 4,766,709

The prior art will be discussed in an INFORMATION DISCLOSURE STATEMENT to be filed at a later date.

SUMMARY OF THE INVENTION

Multiple pane window glass units of the type having abutting pairs of panes fitted between head and sill. Particularly, an "invisible" mullion assembly extending vertically between head and sill and interposed between the vertical edges of each abutting pair of panes, so as to stabilize and support the panes of each pair, together with a T-shaped mullion including an elongate shank with an outer tip vertically extending between abutting pairs of glass pane edges and a flat inner base extending vertically over the abutting inner glass pane edges. A gasket is fitted over the T-shaped mullion during assembly so as to be compressed between the abutting pairs of outer glass pane edges and comes flush with the outer glass face. The gasket includes a deformable outer head fitted onto the mullion tip so as to engage the edges of the outer panes, functioning to shed water (rain) at the ½" wide (±1/16") vertical joint between successive panes of glass.

DESCRIPTION OF THE PREFERRED EMBODIMENTS

Figure 1:
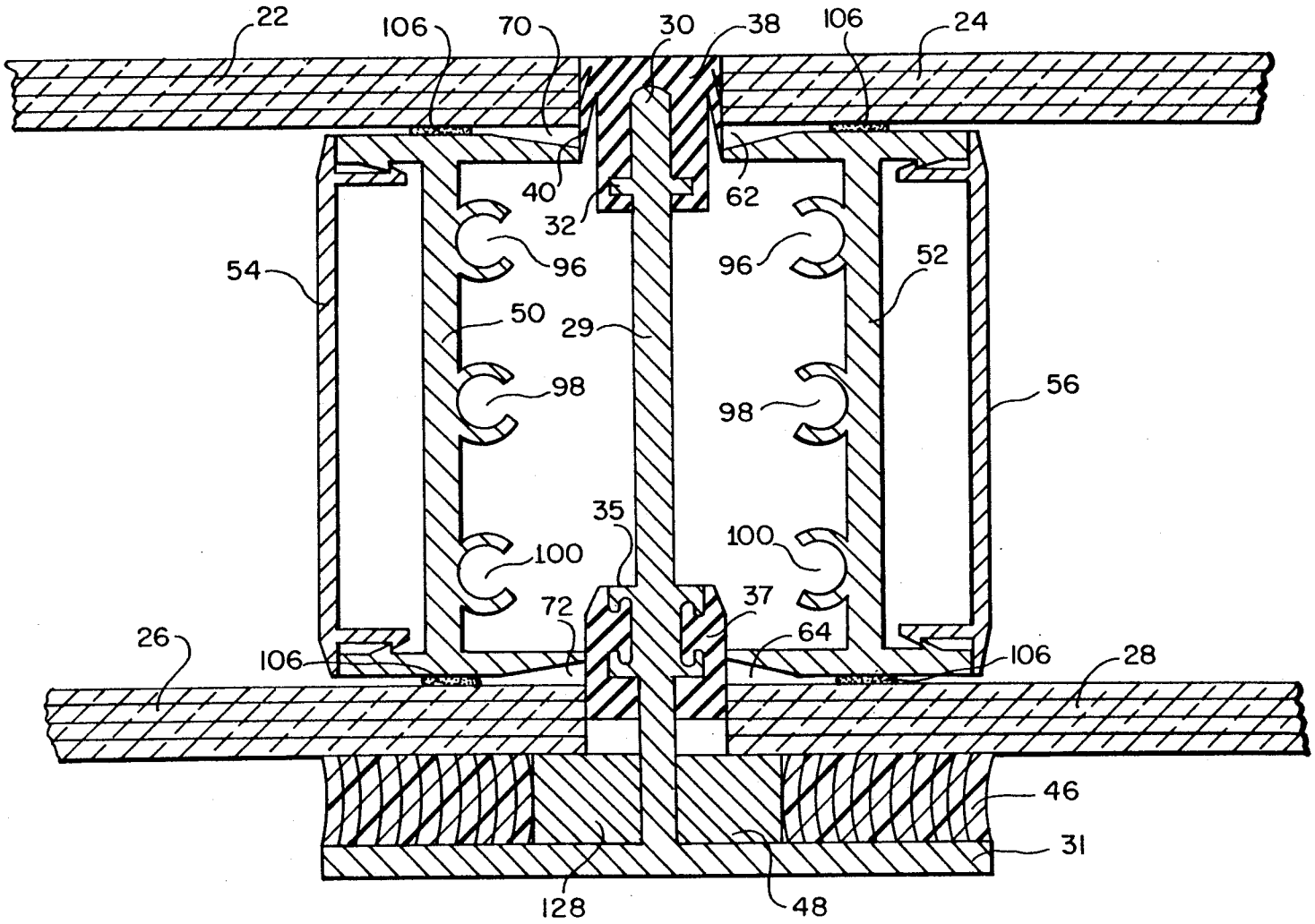
FIG. 1 is a fragmentary top plan partially in horizontal section, depicting a T-shaped mullion and gasket inserted between the abutting edges of a multiple pane glass unit.

In FIG. 1, the vertically extending T-shaped mullion assembly is illustrated as including elongate shank 29, tip 30 and flat inner base 31. The mullion by means of its tip 30 and outer shoulder 32 complementally engages deformable gasket 38, having mushroom-like deformable outer flaps 40. The mullion, also, by means of its grooves 35 and complemental inner gasket 37, fits between the edges of the glass panes 22, 24, 26 and 28.

Abutting outer glass panes 22 and 24 are supported approximately two inches apart from the abutting inner glass pane edges 26 and 28 by means of H-shaped jambs or channels 50 and 52, having inclined inner shoulders and lateral channels 111, whereby sealant 62, 64, 70 and 72 may be applied at the time of manufacture. Foam spacer 128 and 48 may be applied on either side of mullion shank 29 adjacent base 31 and at the time of installation closed by silicone seals 46 at either end.

Figure 3:
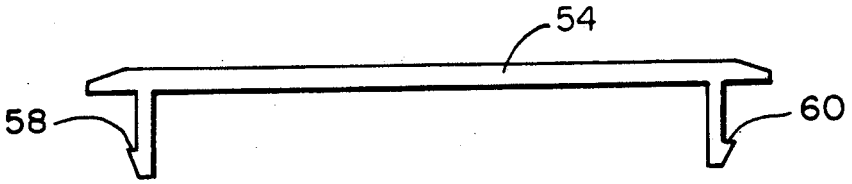
FIG. 3 is a side elevation of the snap fit cover 54 for the H-shaped vertical jamb or channel.
Figure 4:
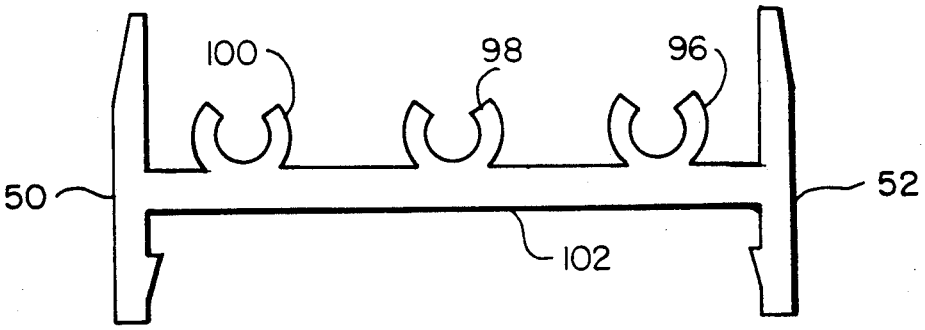
FIG. 4 is a top plan of the vertical H-shaped jamb showing its horizontal screw races.
Figure 5:
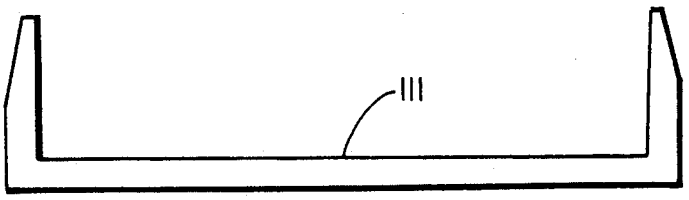
FIG. 5 is an end elevation of channel 111, employed at head and sill of the assembly.

The outer ends of H-shaped members 50, 52 may be closed by caps 54, 56. As shown in FIGS. 3–5, cap 54, inner edges 58, 60, respectively, engage the H-shaped members, such that acoustical material or the like may be contained within the assembly in addition to a desiccating agent (not illustrated).

Figure 2:
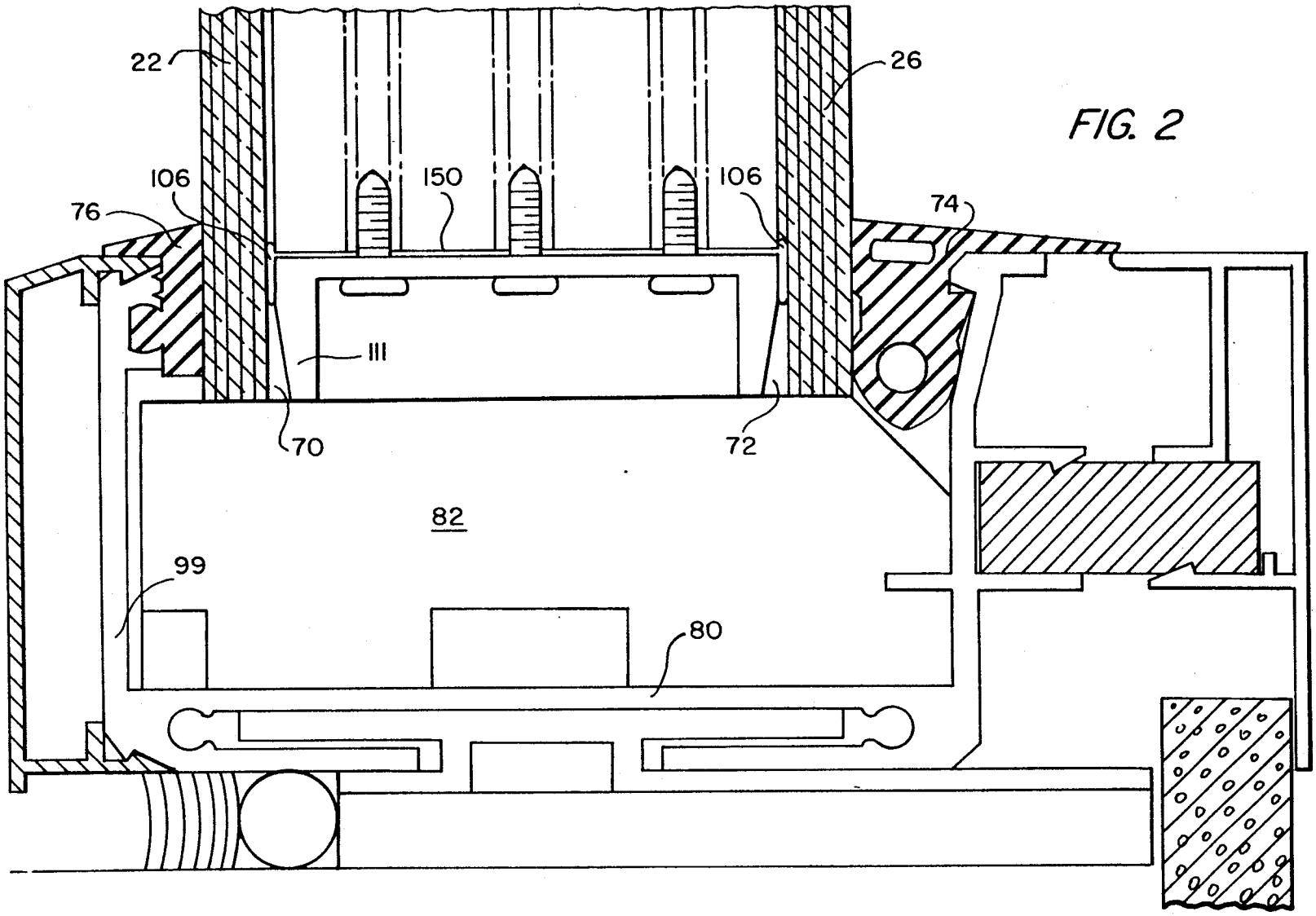
FIG. 2 is a fragmentary transverse section showing the sill and setting block support of the bottoms of the multiple panes, as well as the inboard sealing gasket 74 and outboard sealing gasket 76.

In FIG. 2, outboard pane 22 and inboard pane 26 are shown supported upon setting block 82. Outer pull-in gasket 76 shall be fitted into the space between the sill structure and pane 22. Similarly, inner wedge gasket 74 may be compressed, so as to seal the unit to the receptor.

Figure 6:
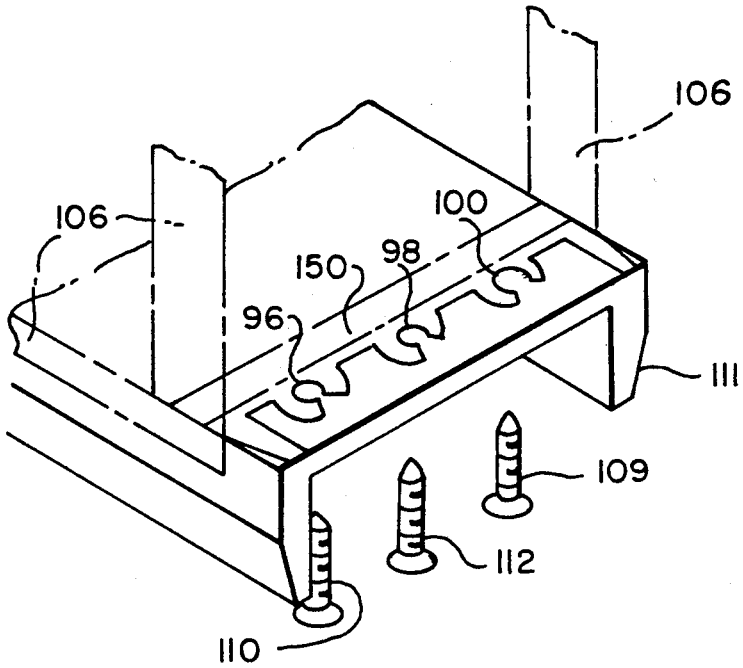
FIG. 6 is a fragmentary perspective, partially in phantom, showing the fitting of the H-shaped member into the sill member and securement by means of vertically extending screws.

In FIG. 4 H-shaped vertical spacer 50 is shown at its head and sill portions wherein central portion 102 defines horizontal screw races 96, 98 and 100 for engagement with vertical screws driven through horizontal spacer channel 111, as illustrated in FIG. 6.

Figure 7:
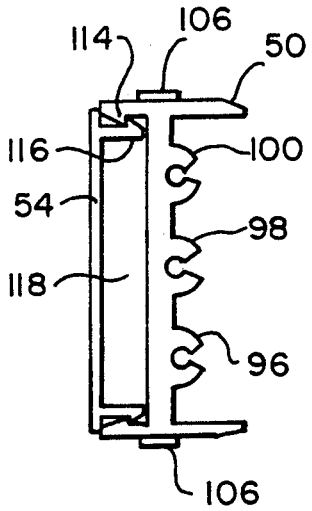
FIG. 7 is a top plan of the H-shaped jamb, showing the fitting of the outer cover illustrated in FIG. 3 onto the H-shaped jamb.

In FIGS. 6 and 7, the H-shaped vertical spacer 50 is illustrated as including three lower screw races 96, 98, 100 engaged by vertical screws 109, 110, 112, extending through the sill channel member 111 on spacer 50. Butyl seal 106 extends vertically and horizontally on the exterior of channel 111.

Figure 8:
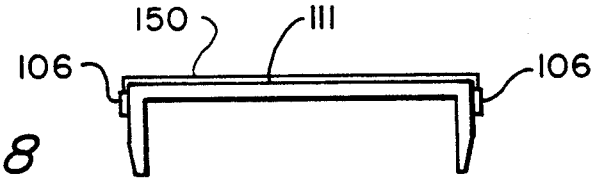
FIG. 8 is an end elevation of channel 111 showing exterior sealing tape 106 interposed between each side and the adjacent glass pane and corner sealing tape 150 interposed between channel 111 and H-shaped vertical jamb.

In FIGS. 7 and 8, vertical butyl seal 106 is illustrated as positioned at the perimeter of the H-shaped vertical spacer 50 and perimeter of channel 11.

Figure 9:
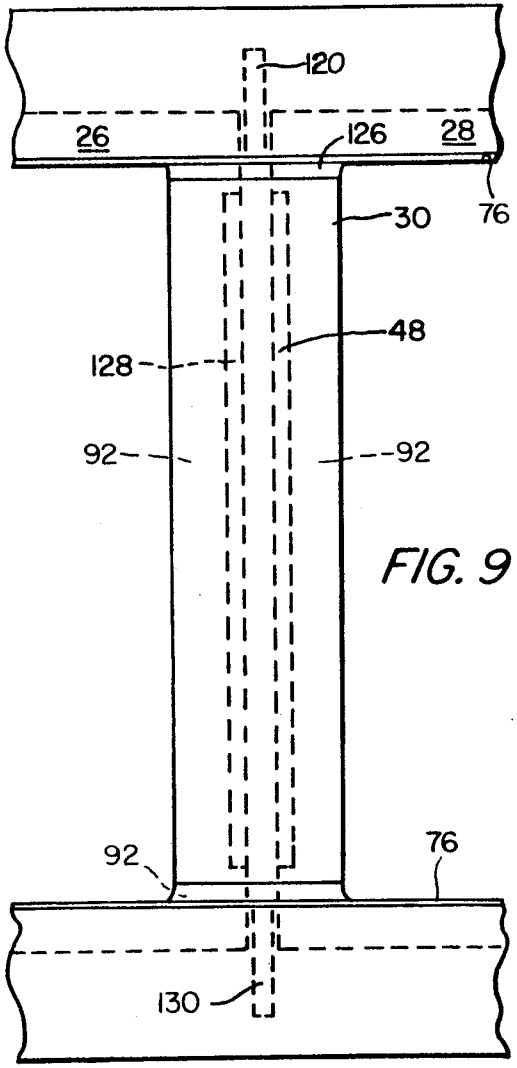
FIG. 9 is a fragmentary front elevation partially in phantom of the inboard assembly, showing the vertically extending mullion in place between the butted glass pane members.

In FIG. 9, inboard panes 26 and 28 are shown with head plug 120 interposed at the top and sill plug 130 interposed at the bottom so as to abut, respectively, an upper glazing gasket (not illustrated) and sill glazing gasket 76, 74. Suitable structural silicone caulking 126 and 92 may be applied at the head and at the sill, so as to close the ¼ inch expansion joint maintained at head and sill. As illustrated in FIG. 1, a similar silicone caulking 46 may be positioned between the outer edges of the mullion base 31 and the tapes 128, 48 on both sides of the mullion elongate shank 29.

Figure 10:
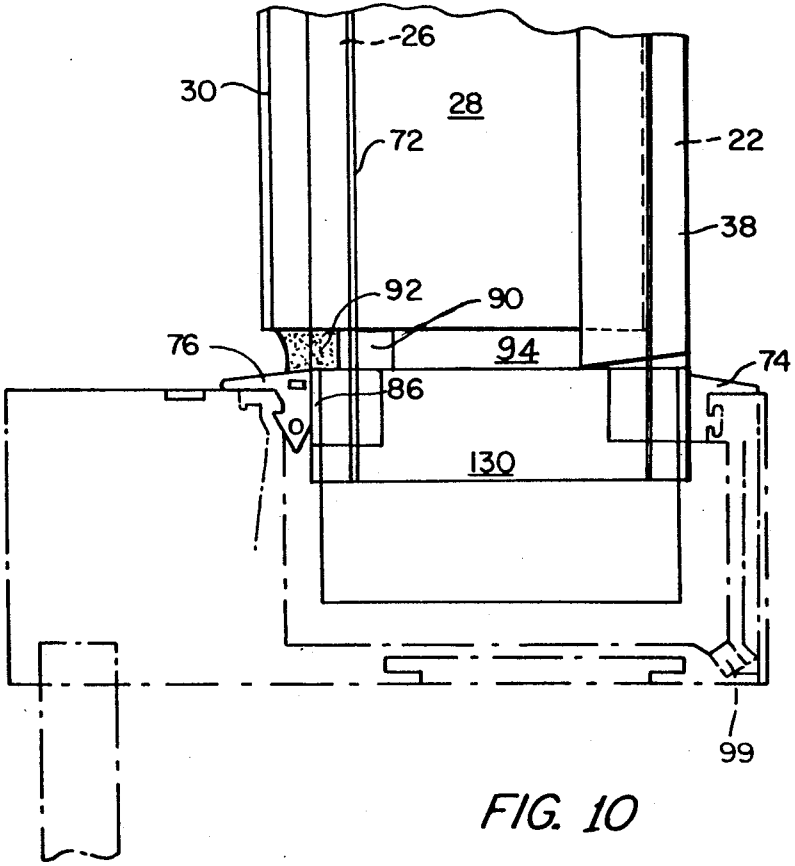
FIG. 10 is a fragmentary side elevation of the mullion, as supported upon the sill member.

In FIG. 10, there is illustrated sill plug 130, butyl tape seals 86 and silicone caulking 92 positioned within the ¼ inch vertical expansion joint 94. Suitable weep holes 99 may be employed at the base of the structure.

Figure 11:
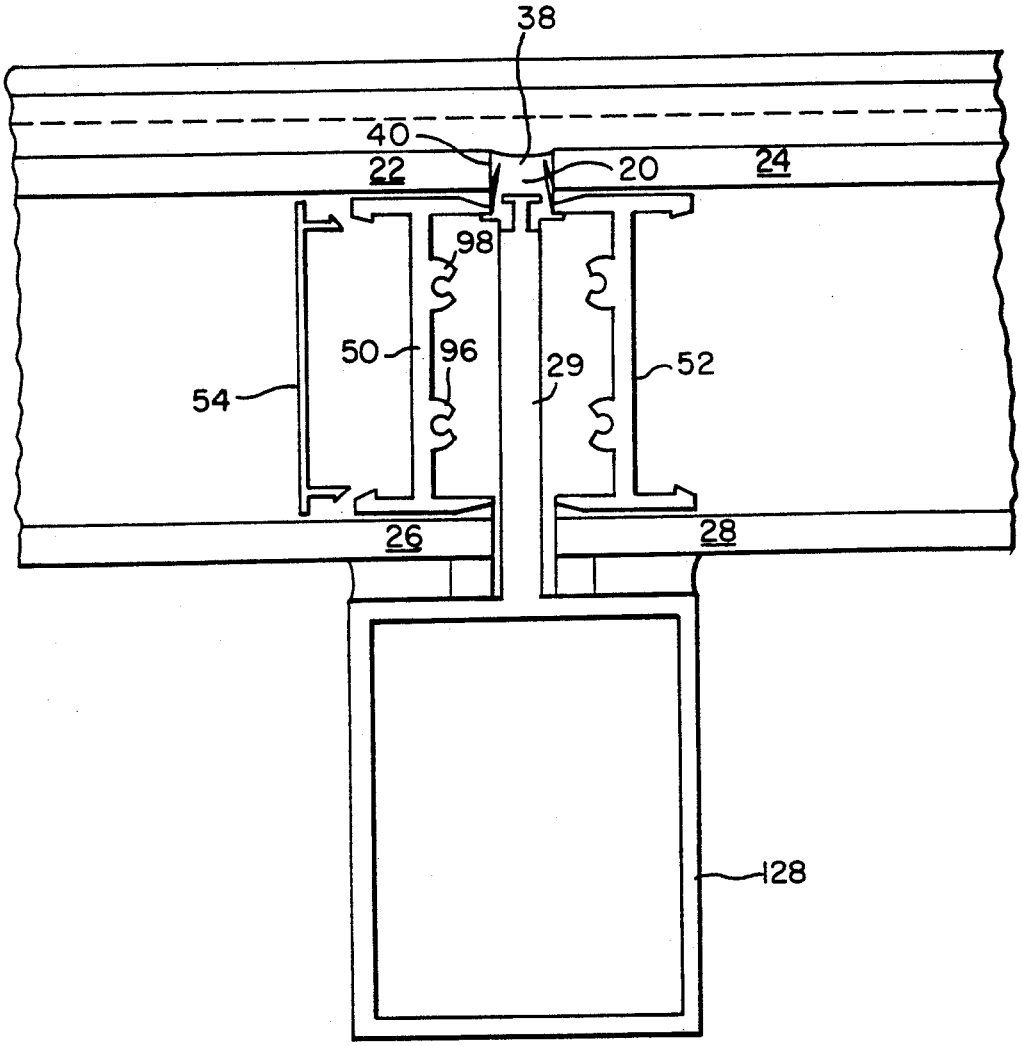
FIG. 11 is a fragmentary plan of the fitting of pairs of pane glass units by means of a modified T-shaped mullion with inwardly extending rectangle 128.

FIG. 11 is a modified assembly wherein the T-shaped mullion 29 includes a heavy mullion inner alternate 128, employed, for example, in meeting a partition of the building.

Figure 12:
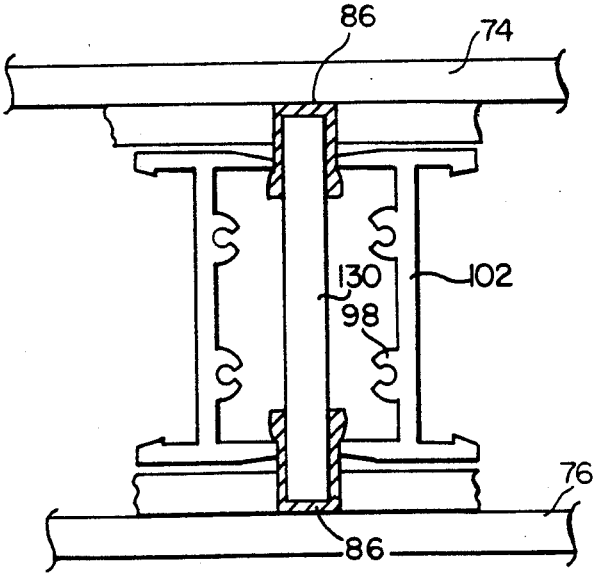
FIG. 12 is a top plan partially in section showing the fitting of butyl tape 86 around transverse plug 130.

In FIG. 12, head plug 120 and sill plug 130 is illustrated with its tape seal 86 encircling either end intermediate the H-shaped jambs.

Figure 13:
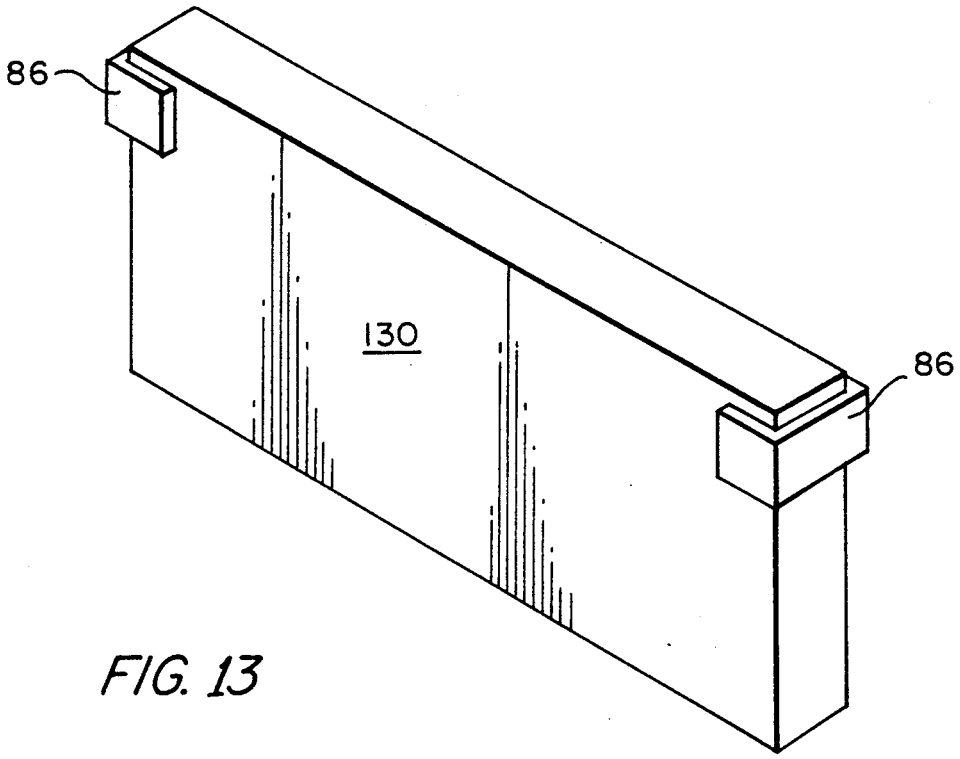
FIG. 13 is a perspective view of plug 130 showing butyl sealing tape 86 sealing the side edges of plug 130.

In FIG. 13, the sill shaped plug 130 is illustrated together with sealing tape 86.

Figure 14:
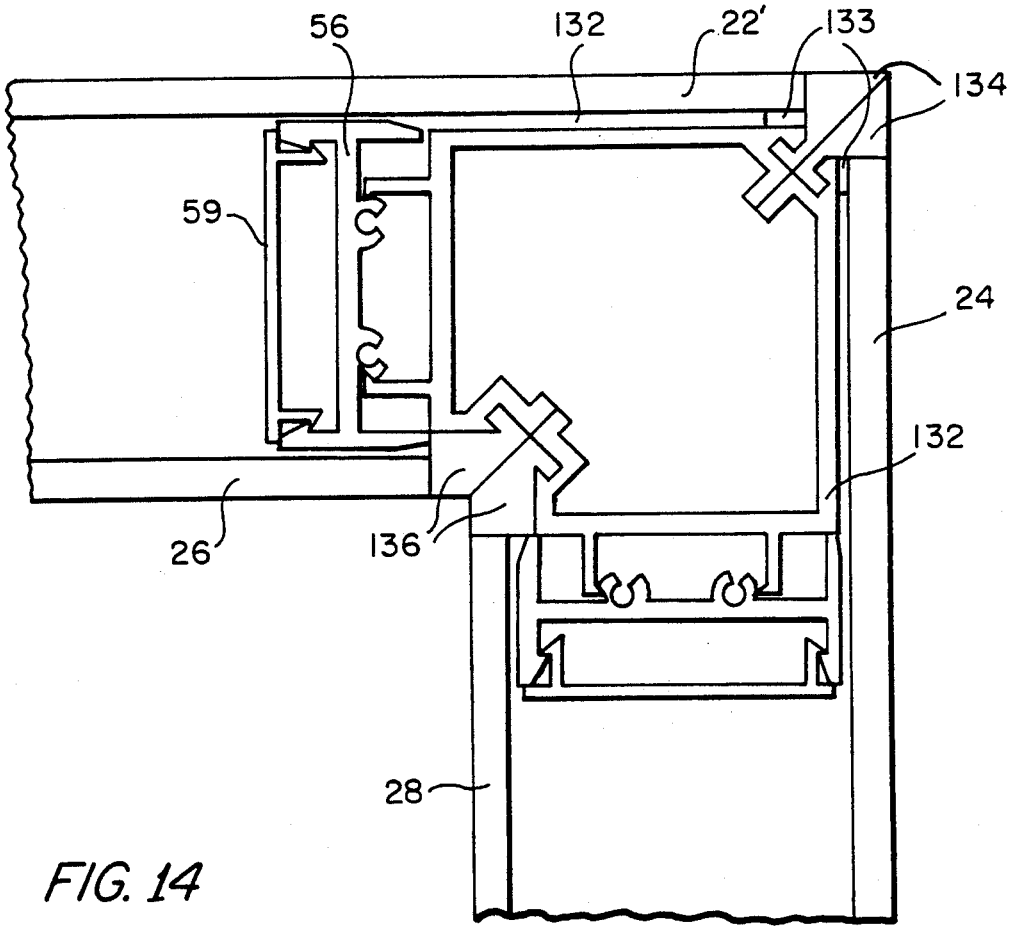
FIG. 14 is a schematic, showing a modified right angle corner assembly.

In FIG. 14, there is illustrated a modified right angle mullion for use at the corners of a building wherein outer gasket 134 is positioned diagonally across from inner gasket 136 and a pair of triangular vertical support members 132 is positioned at the butt ends of the pairs of glass panes. Spacer tape 133 may be interposed between vertical members 132 and the glass pane edges.

Figure 15:
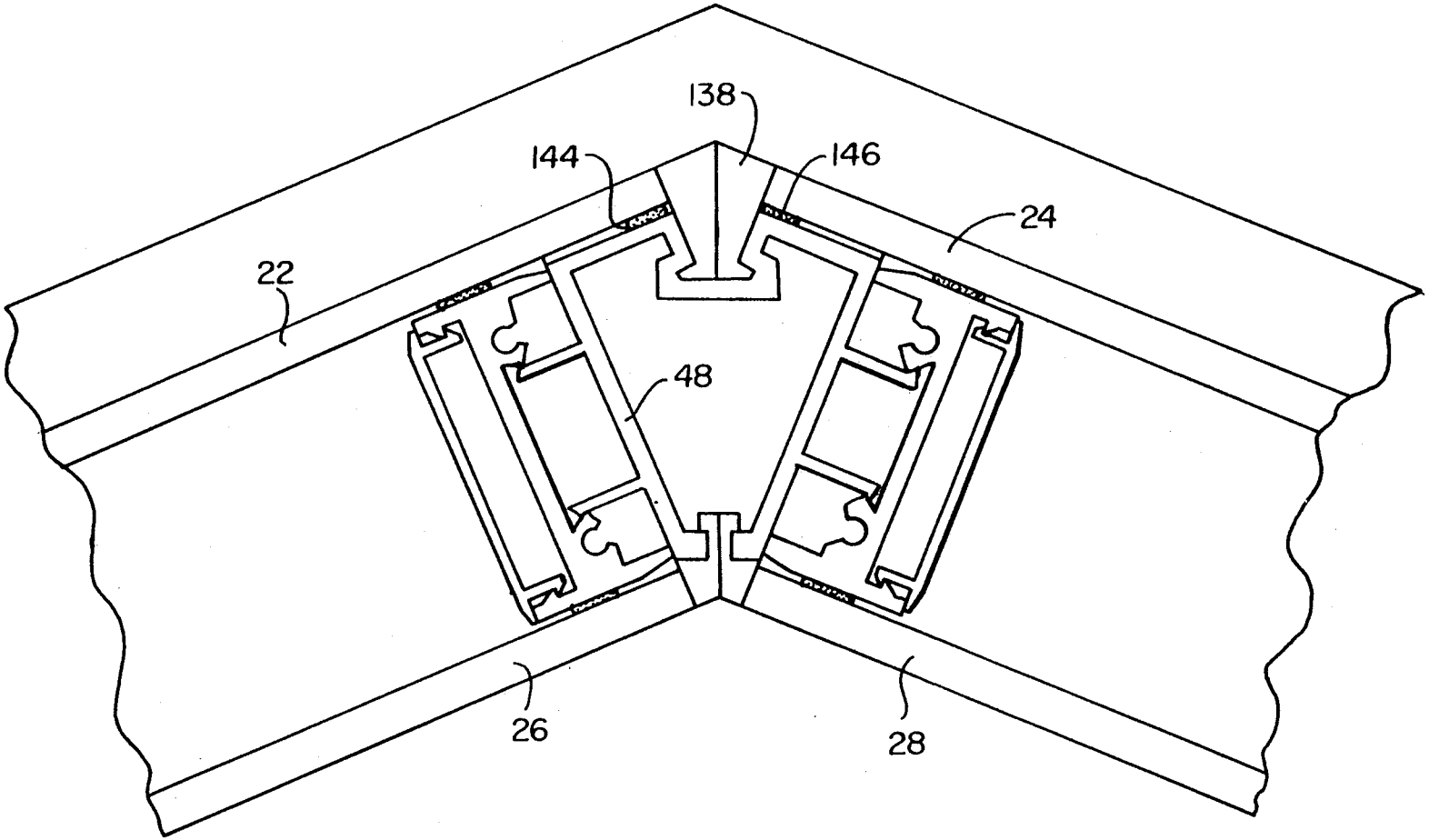
FIG. 15 is a schematic of another modified broad angle corner assembly.

FIG. 15 is a further modification showing a broad angle butting of pair of glass pane ends by means of outer gasket 138 and C-shaped vertical support members 48.

Figure 16:
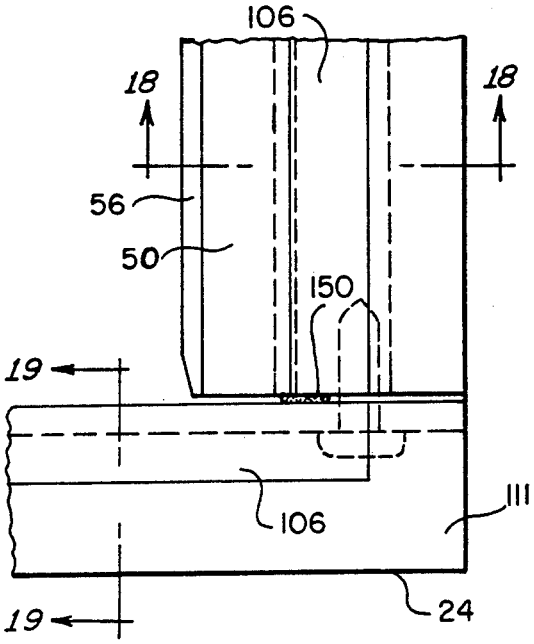
FIG. 16 is a fragmentary front elevation of the H-shaped member depicting the horizontal and vertical perimeter seals 106 and corner seals 150.

In FIG. 16, the left-handed H-shaped member 52 is shown supported on sill channel 111 and including vertical and horizontal butyl sealant strips 106 and strip 150 extending across sill channel 111.

Figure 17:
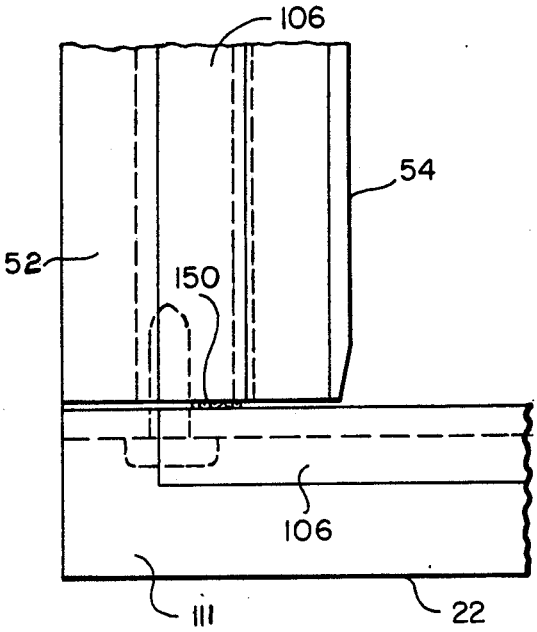
FIG. 17 is a fragmentary front elevation of the right-handed H-shaped member, showing the vertical and horizontal seals 106 and corner seals 150 in place.

In FIG. 17, the right-handed H-shaped member 50 is shown.

Figure 18:
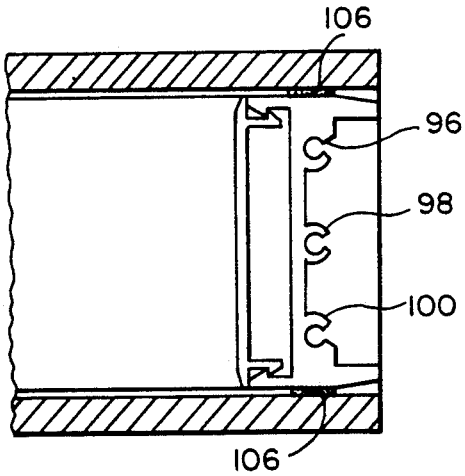
FIG. 18 is a fragmentary top plan showing the positioning of the H-shaped channel members together with the snap-on cap, enabling the positioning of desiccant therein.

In FIG. 18, vertical seal is illustrated interposed on either side of the H-shaped member and a vertically extending snap-on cap is provided so as to enable the positioning of desiccant therein.

Figure 19:
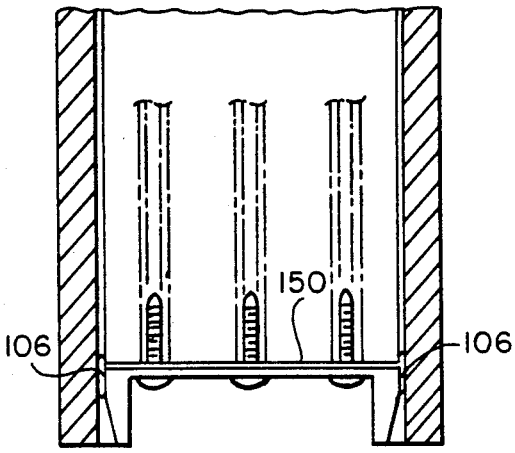
FIG. 19 is a fragmentary side elevation showing the positioning of the horizontal seal 106 and lateral corner seal 150.

In FIG. 19, there is shown the position of the lateral sealant 150 with respect to the perimeter sealant 106.

CONSTRUCTION OF THE "SOUND BARRIER, INVISIBLE MULLION" WINDOW

According to the present "Sound Barrier, Invisible Mullion" window system, units of sealed insulated glass are supported against wind loads by cementing an inverted or concealed T-shaped mullion, using high strength structural silicone, to the vertical edges of adjacent units of glass. The 2 inch H-shaped vertical spacers 50, 52 used to position the insulating glass, while not designed to carry the anticipated wind loads by themselves, in combination with the glass, contribute to a degree to the beam formed by the two glass units and the mullion. The standard mullion is "T" shaped with, for example, a 2¼ inch inner base 31 which acts as a cover plate to conceal caulking 46 at the butt joint and the vertical seal of the glass unit from the inside. The elongate stem shank 29 of the "T" fits between the abutting ends of pairs of glass pane units 22–26 and 24–28 and mounts deformable outer gasket 38 which fills the outside of the vertical joint and is flush with the face of the outer glass panes 22–24. When additional strength is needed or when it is desirable to extend the mullion to the inside to meet a partition, the mullion can be increased in size as required as in FIG. 11. Outer gasket 38 includes deformable mushroom head, defined by resilient lower rim 40 which engages the opposed butt ends of glass panes 22 and 24, such that gasket 38 is urged flush with the outboard glass edges. Mullion elongate shank 29 includes inner grooves 32 which engage gasket 37 with complementally conformed inner shoulders, such that gasket 37 is angled, centered on the edge of the inboard glass.

As the glass is installed, plugs 120, 130 are inserted respectively at the head and at the sill which are flush with the daylight opening. As illustrated in FIGS. 9 and 10, butyl tape 86 is employed as a seal between these plugs and the glass units and between the plugs and the inner and outer horizontal glazing gaskets 76, 74. As illustrated in FIG. 10, the extruded metal portion of the joint seal assembly is cut to a length approximately ½ inch less than the daylight opening and the outside gasket portion of the joint seal assembly is cut to a biased length to daylight. When this assembly is pushed-in place against spacer strips, the outer gasket 38 will fit flush with the outside glass, and, at top and bottom, will fit against the head and sill plugs facing the gasket. The ¼ inch space on the inside at the head and sill is caulked in with structural silicone 92 at the time that mullion and glass units are caulked. This construction permits the head of the window to deflect in relation to the sill without damage to glass or metal through a range of approximately plus or minus ⅜ inch.

As illustrated in FIG. 6, the glass units are constructed by joining H-shaped two inch deep vertical spacers 50, 52 with three screws 109, 110 and 112 at each corner through horizontal spacers 111 into grooved screw races 96, 98, 100 in the verticals. Horizontal spacers 111 are punched to join with vertical H-shaped spacers 50, 52, forming a strong square joint which can be effectively sealed at the corners with a straight cross seal 150 of butylene connecting to the perimeter butylene on both sides of the spacers. With the screw races 96, 98, 100 defined on the deep vertical spacers 50, 52 there is ample room to keep the corner seal 150 of butylene clear of screw locations, so as to be a more effective seal. As illustrated in FIG. 7, the outer side of each spacer 50 facing the sealed air space is notched at 114 so as to engage a snap on cover 54 and complementary bayonet hook 116. Having this pocket 118 on sides of the sealed air space makes it possible to dampen sound waves more effectively, so as to produce a more effective sound deadening unit, and, also, to support a desiccant (not illustrated).

We claim:

1. In a multiple pane window glass unit of the type having abutting pairs of panes fitted between head and sill, a mullion assembly comprising:

(a) a pair of H-shaped vertical channels extending vertically between head and sill and interposed between the vertical edges of each abutting pair of panes, so as to stabilize and support the panes of each pair;

(b) a T-shaped mullion including:

(i) an elongate shank with an outer tip vertically extending between abutting pairs of glass pane edges, such that the outer tip is supported between the outer pane edges, and (ii) a flat inner base extending vertically over the abutting inner glass pane edges; and (c) an elongate gasket fitted over said T-shaped mullion so as to be compressed between the abutting pairs of glass pane edges while engaging said H-shaped channels, said gasket having a deformable outer head fitted onto the mullion tip and engaging the edges of the outer panes and a centering guide engaging the edges of the inner panes.

2. A multiple pane window glass unit as in claim 1, including sealant applied to the inner edges of both the outer and inner glass panes, so as to seal the glass pane edges to the H-shaped channels engaging said gasket.

3. A multiple pane window glass unit as in claim 2, including a sealant positioned between the inner edges of the inner panes and said mullion flat inner base, using a high strength structural silicone.

4. A multiple pane window glass unit as in claim 3, said H-shaped channels supporting an outer vertical cap between the pair of panes, such that material may be supported in the chamber formed by the H-shaped member and the cap.

5. A multiple pane window glass unit as in claim 4, including head and sill plugs respectively interposed transversely between the abutting edges of said pairs of glass pane tops and said pairs of glass pane bottoms and said head and sill.

6. A multiple pane window glass unit as in claim 5, said H-shaped vertical channels including vertically disposed screw races at their top and bottom, so as to receive vertically driven stabilizing screws extending through said head and sill.

7. A multiple pane window assembly as in claim 6, said mullion elongate shank having enlarged shoulders adjacent the mullion tip and adjacent the flat base of said shank so as to complementally engage said gasket and urge said gasket including said outer deformable head and said inner skirt into sealing engagement with abutting glass pane edges, as said mullion is inserted therebetween.

8. A multiple pane window assembly as in claim 7, including vertically extending spacer tape interposed between the abutting edges of the inner panes and said flat base on either side of said mullion elongate shank.

9. A multiple pane window assembly as in claim 8, including head and sill spacers in the form of horizontal channels supported respectively upon head and sill and complementally fabricated to engage and support the top and bottom edges of said H-shaped channels.

10. A multiple pane window assembly as in claim 9, including sealant supported between the vertically extending sides of said H-shaped channels and the inner surfaces of said glass panes in each pair.

11. A multiple pane window assembly as in claim 9, including a sealant extending transversely at the joints between the tip and said vertical H-shaped channels and said head and sill, such that said sealant extends across entire joint and forms the sealant positioned between the inside glass and said channels and also the sealant interposed between the outside glass and the channels.

* * * * *